US007542693B2

(12) United States Patent
Shin et al.

(10) Patent No.: US 7,542,693 B2
(45) Date of Patent: Jun. 2, 2009

(54) PHASE CONTROLLING DEVICE, FUSER CONTROLLING DEVICE HAVING THE SAME, AND PHASE CONTROLLING METHOD

(75) Inventors: Bong-su Shin, Suwon-si (KR); Sang-yong Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 103 days.

(21) Appl. No.: 11/690,302

(22) Filed: Mar. 23, 2007

(65) Prior Publication Data

US 2008/0025745 A1 Jan. 31, 2008

(30) Foreign Application Priority Data

Jul. 28, 2006 (KR) ..... 10-2006-0071780

(51) Int. Cl.
*G03G 15/20* (2006.01)

(52) U.S. Cl. ..... 399/69

(58) Field of Classification Search ..... 399/67, 399/69, 88

See application file for complete search history.

(56) References Cited

U.S. PATENT DOCUMENTS 5,627,634 A * 5/1997 Koh ..... 399/69
5,907,743 A * 5/1999 Takahashi ..... 399/69
5,942,882 A * 8/1999 Ohta ..... 399/69 X
6,449,445 B1 * 9/2002 Nakamori et al. ..... 399/69
6,853,818 B2 * 2/2005 Nishida ..... 399/67
2006/0140691 A1 6/2006 Kim et al.

FOREIGN PATENT DOCUMENTS

JP 4-318586 11/1992
JP 2000-172109 * 6/2000
JP 2002-171750 6/2002

OTHER PUBLICATIONS

Extended European Search Report issued Nov. 20, 2007 from the European Patent Office with respect to European Patent Application No. 07107745.7 filed on May 8, 2007.

* cited by examiner

*Primary Examiner*—Sandra L Brase
(74) *Attorney, Agent, or Firm*—Stein McEwen, LLP

(57) ABSTRACT

A phase controlling device of reduced cost, a fuser controlling device including the phase controlling device, and a phase controlling method. The phase controlling device includes: a first signal generating unit generating an error signal that corresponds to a difference between the reference temperature of the fuser and the actual temperature of the fuser; a pulse generating unit generating a sawtooth wave pulse signal that increases with time during a half period of the AC power; and a control signal generating unit comparing the error signal and the sawtooth wave pulse signal and outputting a phase control signal controlling phase of the AC power. The pulse generating unit generating an increasing sawtooth wave pulse may have a relatively simple circuit configuration relative to that of the pulse generating unit generating a decreasing sawtooth wave pulse, thereby reducing manufacturing costs.

26 Claims, 9 Drawing Sheets

PHASE CONTROLLING DEVICE, FUSER CONTROLLING DEVICE HAVING THE SAME, AND PHASE CONTROLLING METHOD

CROSS-REFERENCE TO RELATED APPLICATION

This application claims benefit of Korean Patent Application No. 2006-71780, filed Jul. 28, 2006 in the Korean Intellectual Property Office, the disclosure of which is incorporated herein by reference.

BACKGROUND OF THE INVENTION

1. Field of the Invention

Aspects of the present invention relate to a phase controlling device, a fuser controlling device having the same, and a phase controlling method. More specifically, an aspect of the present invention relates to a phase controlling device using less circuit elements, thus simplifying the configuration of the device and reducing manufacturing costs, a fuser controlling device having the same, and a phase controlling method.

2. Description of the Related Art

An image forming apparatus is an apparatus printing images corresponding to input image data on a recording medium, such as paper, transparency, etc. These apparatuses include printers, photocopiers, facsimiles, multi-function printers and so on.

In general, the image forming apparatus includes a heat generating device enabling normal print jobs and a device for maintaining the heat of the heat generating device at a certain temperature. In particular, a fuser which functions to fix toner images on paper under heat and pressure needs a fuser controlling device for keeping the surface of the fuser at an appropriate target temperature to fix toner images on paper, a transparency, etc.

Such a fuser controlling device is generally operated by a phase controller which controls an applied AC power. To carry out the phase control, the fuser controlling device requires a phase controlling device that detects a difference between a target or reference temperature of the fuser and practical temperature, i.e., present or actual temperature, of the fuser, generates an error signal corresponding to the detected difference between target temperature and present temperature, and outputs a phase control signal having a variable pulse width based on the error signal generated.

Moreover, in order to output such a phase control signal having a variable pulse width, the fuser controlling device needs a pulse generation unit that outputs predetermined pulse signals.

FIG. 7 is a block diagram of a phase controlling device according to a conventional example, FIG. 8 is a circuit diagram of an example of a signal generation unit shown in FIG. 7, and FIGS. 9A-9D and 10A-10D are drawings explaining a driving method of a fuser controlling device provided with the phase controlling device in FIG. 7.

Referring to FIGS. 7 and 8, the phase controlling device 10 according to a conventional example includes a pulse generation unit 20, a signal generation unit 30, and a PWM controller 40.

The pulse generation unit 20, as shown in FIGS. 9A-9D, generates a sawtooth wave pulse signal Vramp' that changes in time during a half period of AC power.

The signal generation unit 30 senses actual temperature of a fuser included in an image forming apparatus (not shown), and receives from a temperature sensor (not shown) a temperature detection signal Vact_temp' having a predetermined voltage level according to the sensed temperature. In addition, the signal generation unit 30 receives a reference temperature signal Vref_temp' corresponding to a predetermined target or reference temperature of the fuser that has been set to a main controller of the image forming apparatus or the PWM controller 40.

The signal generation unit 30 calculates a difference between the inputted target or reference temperature and the present temperature, and outputs an error signal Verr' having a voltage level corresponding to the temperature difference therebetween.

For instance, as shown in FIG. 8, the signal generation unit 30 can include a subtractor circuit. If the actual temperature of the fuser is relatively higher than the reference temperature, an actual temperature detection signal Vact_temp' and a reference temperature signal Vref_temp' are subtracted through the subtractor circuit, and the error signal Ver', similar to a second error signal Verr2' shown in FIGS. 9A-9D, having a relatively low voltage in inverse proportion to an increase in temperature of the fuser is outputted.

Meanwhile, if the actual temperature of the fuser is relatively lower than the reference temperature, an actual temperature detection signal Vact_temp' and a reference temperature signal Vref_temp' are subtracted through the subtractor circuit, and the error signal Verr', similar to a first error signal Verr1' shown in FIGS. 9A-9D, having a relatively high voltage level in inverse proportion to a decrease in temperature of the fuser is outputted.

The PWM controller 40 receives the sawtooth wave pulse signal Vramp' outputted from the pulse generation unit 20 and the error signal Verr' outputted from the signal generation unit 30, compares voltage levels of both signals, and outputs a phase control signal having a pulse width corresponding thereto.

To this end, the PWM controller 40 may have a comparator capable of comparing the voltage level of the error signal Verr' with the voltage level of the sawtooth wave pulse signal Vramp'.

At this time, the PWM controller 40 outputs, as depicted in FIGS. 9A-9D, a phase control signal Vphase' having a high phase, only if the voltage level of the error signal Verr' is higher than the voltage level of the sawtooth wave pulse signal Vramp' according to the comparison result of the voltage levels between the error signal Verr' and the sawtooth wave pulse signal Vramp'.

Therefore, as described above, if the actual temperature of the fuser is relatively higher than the reference temperature, an error signal Verr outputted from the signal generation unit 30 may have the voltage level of the second error signal Verr2'; while if the actual temperature of the fuser is relatively lower than the reference temperature, the error signal Verr may have the voltage level of the first error signal Verr1'. Accordingly, as shown in FIGS. 9A-9D, a pulse width of the phase control signal Vphase' generated when the second error signal Verr2' is outputted is relatively narrower; while a pulse width of the phase control signal Vphase' generated when the first error signal Verr1' is outputted is relatively broader.

In addition, although not shown in the drawing, when the image forming apparatus (not shown) is started, or restarted from the standby mode that restricts the operation of the fuser to reduce power consumption by not printing, a charging element like a capacitor is provided to the PWM controller 40 to block or prevent transient current flow to the fuser at the time of operation. As shown in FIGS. 10A-10D the signal generation unit 30 outputs the error signal Verr' that increases gradually.

The PWM controller 40 compares the sawtooth wave pulse signal Vramp and the error signal Verr' received, and outputs a phase control signal Vphase' having a gradually increasing pulse width. By this phase control signal Vphase', a phase of alternating current power AC is controlled and a phase controlled alternating current power AC_IN is applied to the fuser. In this way, it is possible to prevent transient current flow to the fuser at the beginning of its operation.

The fuser controlling device provided with the above-described phase controlling device controls phase of the applied alternating current power AC by using a phase control signal having a variable pulse width according to the actual temperature, and applies the phase controlled alternating current power AC_IN to the fuser. Accordingly, if the time for impressing AC_IN is relatively long, exothermic temperature of the fuser increases; while if the time for impressing AC_IN is relatively short, exothermic temperature of the fuser decreases, keeping the reference temperature.

Therefore, in order to output a phase control signal using a sawtooth wave pulse that decreases with the passage of time, the phase controlling device 10, as shown in FIG. 8, includes the signal generation unit 30 to which a temperature detecting signal Vact_temp' with its polarity reversed is applied. Then, a subtractor is realized using a bipolar power supply +V and −V for OP-AMP of the signal generation unit 30.

However, to build such a subtractor, a circuit for generating a reversed polarity voltage as shown in the drawing is additionally needed. This consequently makes it difficult to attain integration and increases the cost of manufacture.

Another problem with the conventional device is the cost of manufacturing the phase controlling device needed for generating a sawtooth wave pulse.

That is, although the phase controlling device 10 having the pulse generation unit 20 and the signal generation unit 30 is formed into a single chip exclusive for phase control, it increases the cost of manufacture of such structure and further the cost of manufacture of a fuser controlling device having the same and an image forming apparatus having all these are increased.

SUMMARY OF THE INVENTION

Aspects of the present invention provide a phase controlling device to realize integration and reduction of manufacturing cost.

Additional aspects and/or advantages of the invention will be set forth in part in the description which follows and, in part, will be obvious from the description, or may be learned by practice of the invention.

According to an aspect of the present invention, there is provided a fuser controlling device provided with the phase controlling device.

According to another aspect of the present invention, there is provided a phase controlling method for controlling the phase of AC power using a pulse signal that increases with the passage of time.

According to an aspect of the present invention, there is provided a phase controlling device including a first signal generating unit, a pulse generating unit, and a control signal generating unit. The first signal generating unit generates an error signal that corresponds to a difference between the target or reference temperature of the fuser and the present or actual temperature of the fuser. The pulse generating unit generates a sawtooth wave pulse signal that increases with passage of time during a half period of the AC power. The control signal generating unit compares the error signal and the sawtooth wave pulse signal and outputs a phase control signal controlling phase of the AC power.

According to an aspect of the present invention, the phase controlling device may further include a second signal generating unit generating a soft start signal that drives the fuser gradually to prevent transient current flow occurring during starting of the fuser, and for providing the soft start signal to the control signal generating unit.

According to an aspect of the present invention, the soft start signal generated by the second signal generating unit may have a voltage level decreasing with the passage of time.

According to an aspect of the present invention, the control signal generating unit compares a voltage level of the soft start signal and a voltage level of the sawtooth wave pulse signal since starting of the fuser, and outputs the phase control signal having a pulse width that gradually increases.

Preferably, but not necessarily the second signal generating unit includes a differential circuit formed between a power supply voltage having a predetermined voltage level and a ground voltage. In this case, the second signal generating unit further includes a switching element that is connected in parallel to a charging element included in the differential circuit to discharge the charging element charged with electricity.

Moreover, the first signal generating unit according to an aspect of the present invention may include a subtractor for carrying out subtraction of the target or reference temperature and the present or actual temperature being inputted, in which the subtractor is driven by a monopole voltage and outputs the error signal having a voltage level in proportion to temperature variation of the fuser.

According to an aspect of the present invention, the subtractor includes an OP-AMP comprising a non-inversion input terminal to which a voltage level corresponding to the target or reference temperature is inputted and an inversion input terminal to which a voltage value corresponding to the present or actual temperature is inputted.

According to an aspect of the present invention, the control signal generating unit compares a voltage level of the error signal outputted from the subtractor and a voltage level of the sawtooth wave pulse signal, and outputs the phase control signal of a high voltage level in the case that the voltage level of the sawtooth wave pulse signal is higher than the voltage level of the error signal.

Another aspect of the present invention may provide a fuser controlling device including a power supply unit, a phase controlling unit, and a fuser controlling unit. The power supply unit applies an alternating current (AC) power to the fuser. The phase controlling unit outputs a phase control signal controlling phase of the AC power by using a pulse signal that increases with the passage of time during a half period of the AC power. The fuser controlling unit is activated selectively by the phase control signal, and controls an application of the AC power to the fuser.

According to an aspect of the present invention, the phase controlling unit may include a first signal generating unit generating an error signal that corresponds to a difference between the target or reference temperature of the fuser and the present or actual temperature of the fuser; a pulse generating unit generating a sawtooth wave pulse signal that increases with passage of time during a half period of the AC power; and a control signal generating unit comparing the error signal and the sawtooth wave pulse signal and outputting a phase control signal controlling phase of the AC power.

According to an aspect of the present invention, the phase controlling unit may further include a second signal generating unit generating a soft start signal that drives the fuser gradually to prevent transient current flow occurring during starting of the fuser, and providing the soft start signal to the control signal generating unit.

According to an aspect of the present invention, the soft start signal generated by the second signal generating unit has a voltage level decreasing with the passage of time.

According to an aspect of the present invention, the control signal generating unit compares a voltage level of the soft start signal and a voltage level of the sawtooth wave pulse signal since starting of the fuser, and outputs the phase control signal having a pulse width that gradually increases.

According to another aspect of the present invention, the first signal generating unit, it driven by a monopole voltage, outputs the error signal having a voltage level in proportion to temperature variation of the fuser.

According to another aspect of the present invention, the first signal generating unit outputs the error signal having a voltage level in proportion to temperature variation of the fuser.

According to an aspect of the present invention, the control signal generating unit compares a voltage level of the error signal outputted from the first signal generating unit and a voltage level of the sawtooth wave pulse signal, and outputs the phase control signal of a high voltage level when the voltage level of the sawtooth wave pulse signal is higher than the voltage level of the error signal.

Still another aspect of the present invention provides a phase controlling method including generating an error signal corresponding to a difference between the target or reference temperature of the fuser and the present or actual temperature of the fuser; generating a sawtooth wave pulse signal that increases with passage of time during a half period of the AC power; and comparing the error signal and the sawtooth wave pulse signal and thereby, outputting a phase control signal controlling phase of the AC power.

According to another aspect of the present invention, the phase controlling method may further include generating a soft start signal that drives the fuser gradually to prevent transient current flow occurring during starting of the fuser.

According to another aspect of the present invention, the soft start signal has a voltage level that decreases with the passage of time from the starting of the fuser.

According to another aspect of the present invention, the phase control signal has a pulse width that increases gradually with the passage of time from the starting of the fuser.

According to another aspect of the present invention, the error signal has a voltage level in proportion to temperature variation of the fuser.

According to another aspect of the present invention, the phase control signal is outputted as a high voltage level signal when a voltage level of the sawtooth wave pulse signal is higher than a voltage level of the error signal.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
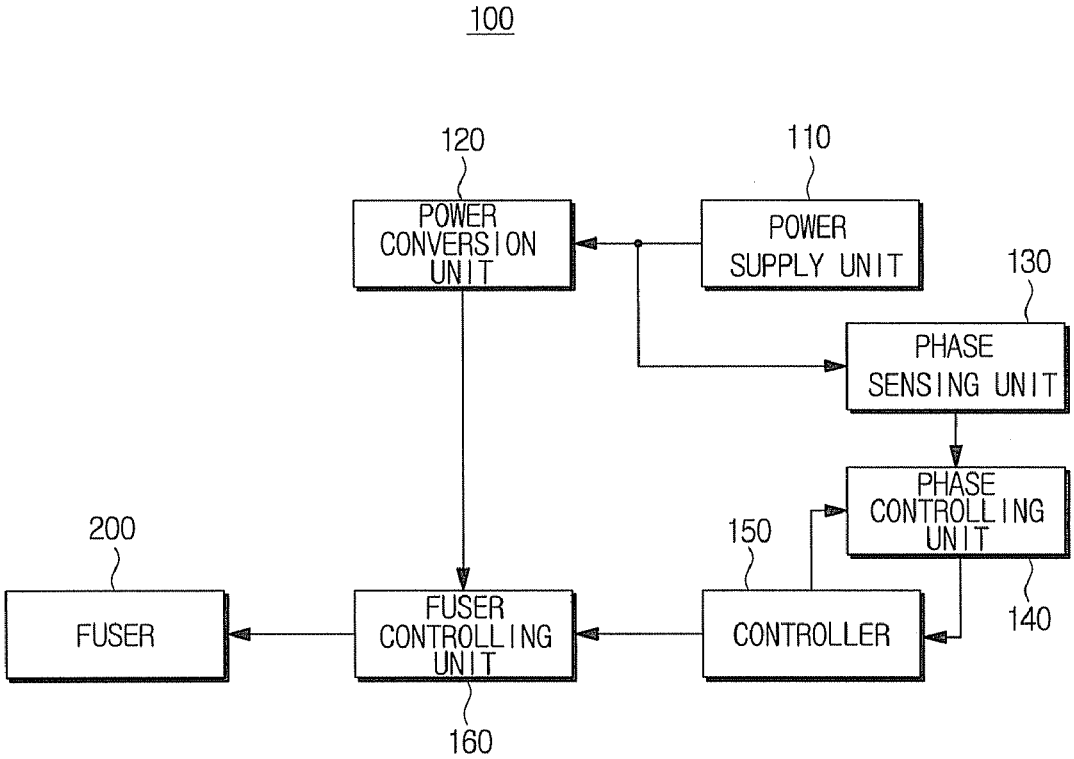
FIG. 1 is a block diagram explaining a fuser controlling device according to one embodiment of the present invention.

Reference will now be made in detail to the present embodiments of the present invention, examples of which are illustrated in the accompanying drawings, wherein like reference numerals refer to the like elements throughout. The embodiments are described below in order to explain aspects of the present invention by referring to the figures.

Figure 2:
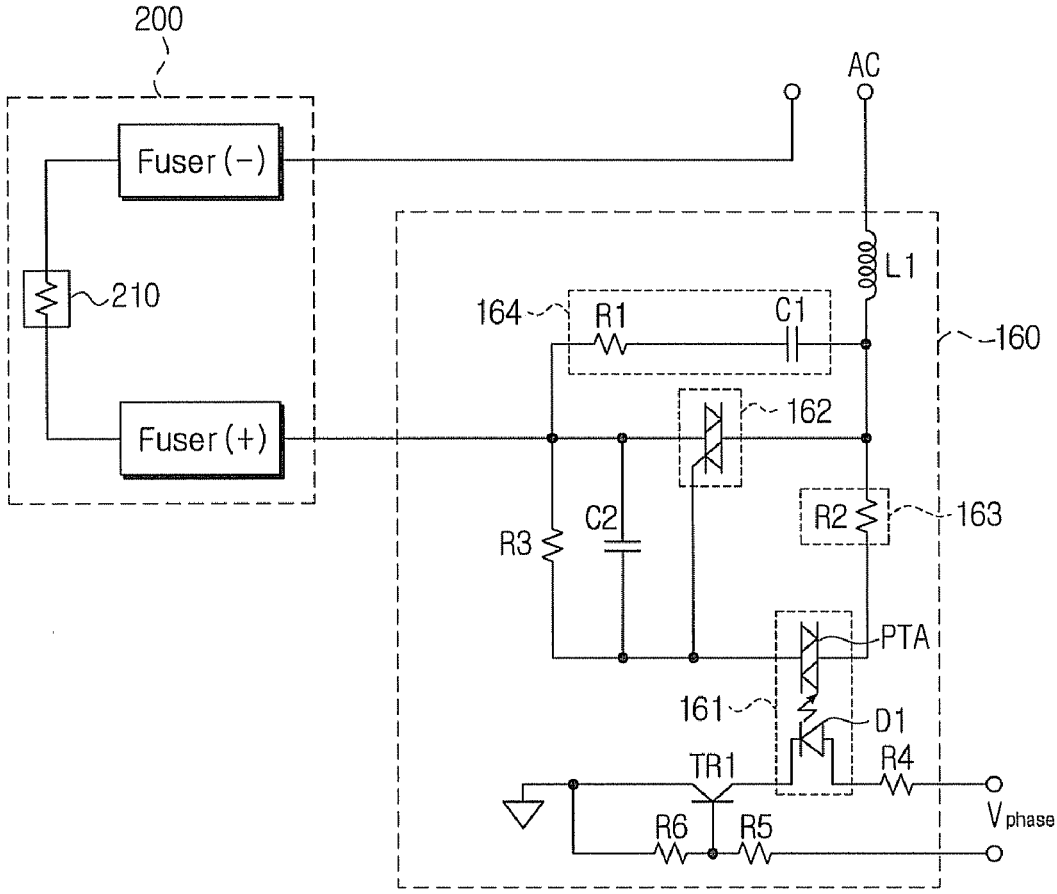
FIG. 2 is a circuit diagram illustrating in detail a temperature control unit of FIG. 1.

FIG. 1 is a block diagram explaining a fuser controlling device according to one embodiment of the present invention, and FIG. 2 is a circuit diagram illustrating in detail a temperature control unit of FIG. 1;

Referring to FIG. 1, the fuser controlling device 100 according to one embodiment of the present invention includes a power supply unit 110, a power conversion unit 120, a phase sensing unit 130, a phase controlling unit 140, a controller 150 and a fuser controlling unit 160.

In detail, the power supply unit 110 is constituted by a switching mode power supply (SMPS), and outputs AC power to the power conversion unit 120 and the phase sensing unit 130.

The power conversion unit 120 converts the level of AC power outputted from the power supply unit 110, and outputs the converted power to the fuser controlling unit.

The phase sensing unit 130 detects zero-cross points of AC power using AC power outputted form the power supply unit 110, and outputs a phase detection signal between the zero-cross points. At this time, the phase sensing unit 130 may receive AC power from the power supply unit 110, or level-converted AC power from the power conversion unit 120 that converts the level of AC power from the power conversion unit 120.

The phase controlling unit 140 outputs a phase control signal using a phase detection signal outputted from the phase sensing unit 130. That is, the phase controlling unit 140 outputs a phase control signal for controlling the phase of AC power by using the output time of the phase detection signal from the phase sensing unit 130, and the start point or the end point of the phase detection signal output.

The operation of such a phase controlling unit 140 will be described later.

The controller 150 outputs a control signal controlling the overall operation of each unit in the fuser controlling device 100. In particular, the controller 150 receives the phase control signal from the phase controlling unit 140, controls its output timing, and outputs the signal.

The controller 150 checks present or actual temperature status of the fuser 200 to generate a temperature detection signal having a voltage level corresponding to the present or actual temperature, and outputs the signal to the phase controlling unit 140. Here, a target or reference temperature providing a reference value thereof can be set in the controller 150 so that the exothermic temperature of the fuser 200 can be set and kept at a predetermined temperature. Then, the controller 150 outputs a reference temperature signal having a voltage level corresponding to the target or reference temperature to the phase controlling unit 140.

In this manner, the phase controlling unit 140 generates an error signal corresponding to a difference between the reference temperature signal and the temperature detection signal applied from the controller 150, compares the generated error signal and a predetermined pulse signal, and outputs the above-described phase control signal.

The fuser controlling unit 160 receives AC power from the power conversion unit 120 and controls the AC power input in response to the phase control signal applied from the controller 150, thereby controlling the temperature of the fuser 200.

In detail, referring to FIG. 2, the fuser controlling unit 160 includes a switching unit I 161 activated by a phase control signal Vphase applied from the controller 150, a switching unit II 162 activated by the switching unit I 161, a current limiting unit 163 reducing the amount of current flowing to the switching unit I 161, and a noise prevention unit 164 reducing noises generated from the activation of the switching unit II 162.

The switching unit I 161 includes a light-emitting element D1 such as an LED, and a light-receiving element such as a PHOTO-TRIAC (PTA) activated by the light-emitting element D1. The light-emitting element D1 generates a predetermined light according to the operation of a transistor TR1 that is selectively turned on by the phase control signal Vphase applied from the controller 150. The generated light is incident on the PTA and activates the same. As the PTA is activated, the current flow path is formed. One end of the light-emitting element D1 is connected to one end of the transistor TR1, and the PTA is installed at a position opposite to the light-emitting element D1.

The switching unit II 162 includes a switching element such as TRIAC (TA) activated by a control input. The switching unit II 162 is activated by the PTA of the switching unit I 161. Namely, as the PTA becomes electrically conductive, a current from the power conversion unit 120 is inputted to the switching unit II 162.

Therefore, phase of the applied AC power from the power conversion unit 120 is controlled by the transistor TR1 that is activated selectively by the phase control signal Vphase and by the switching operations of the respective switching units 161 and 162, and is applied to the fuser 200.

The current limiting unit 163 is installed to reduce the amount of AC power flowing into the switching unit I 161, the AC power having traveled via the fuser 200 and the switching unit II 162 (provided that the switching unit II 162 was activated).

The noise prevention unit 164 is provided to prevent noises that are generated when the switching unit II 162 is activated. For example, the noise prevention unit 164 serves to prevent noises such as from a spark, produced when the internal pressure of TA of the switching unit II 162 rapidly changes to the turn-on voltage from 0V.

Here, the fuser 200 includes a heating roller and a pressing roller (not shown).

The heating roller is for fusing an image formed by a developer sprayed onto a printing paper with heat. The heating roller has a heating element 210 inside for converting AC power, that is, electric energy, impressed from the power supply unit 120 to heat energy.

Such a heating element 210 may be a halogen lamp for example.

The pressing roller is installed to be rotatable in contact with the heating roller so that the pressing roller can fuse the image formed by a developer sprayed onto the printing paper with pressure.

Thus, the temperature controlling unit 160 controls the exothermic temperature of the heating element 210 to heat and maintain the surface of the heating roller inside the fuser 200 at a predetermined temperature.

Through this procedure, the phase controlled AC power is provided to the heating element 210 inside the fuser 200 to heat the heating element 210. As the heating element 210 is heated, the surface of the heating roller is heated up to a predetermined target or reference temperature and is maintained at the target or reference temperature. This heat from the heating element 210 is then used to fuse a toner image printed over an OPC (Organic Photo-Conductive) drum (not shown) of the image forming apparatus and a printing paper.

Figure 3:
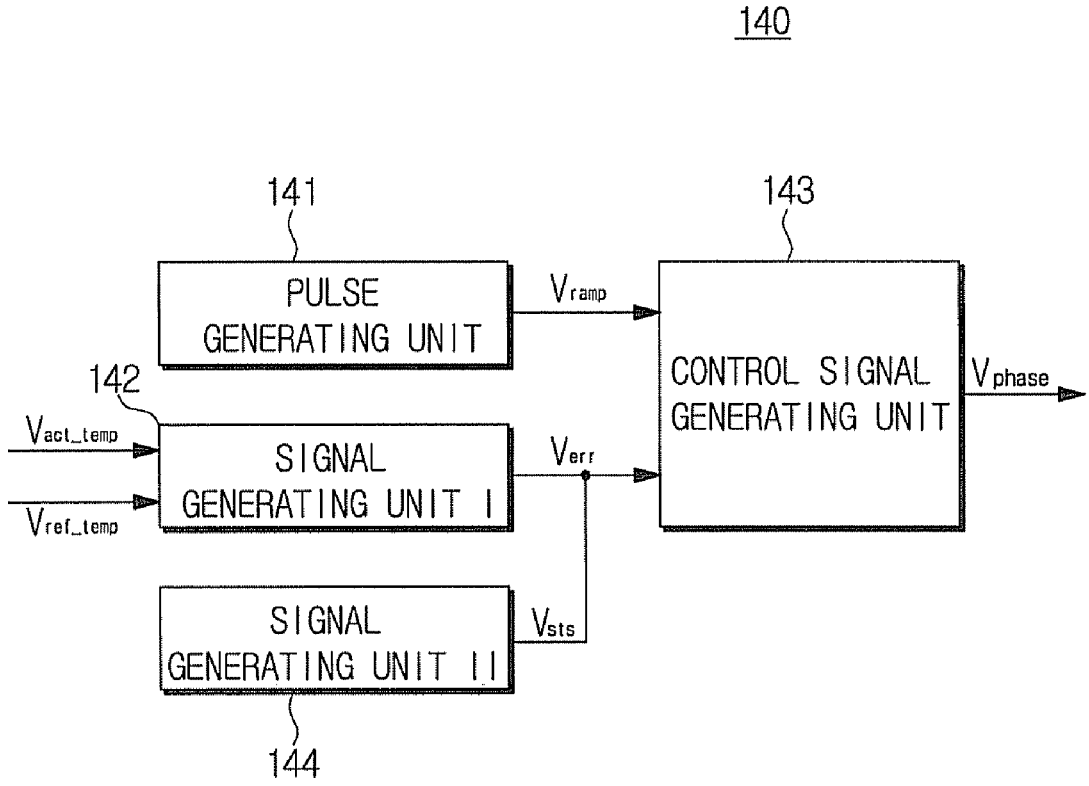
FIG. 3 is a block diagram explaining a phase controlling device according to one embodiment of the present invention.
Figure 4:
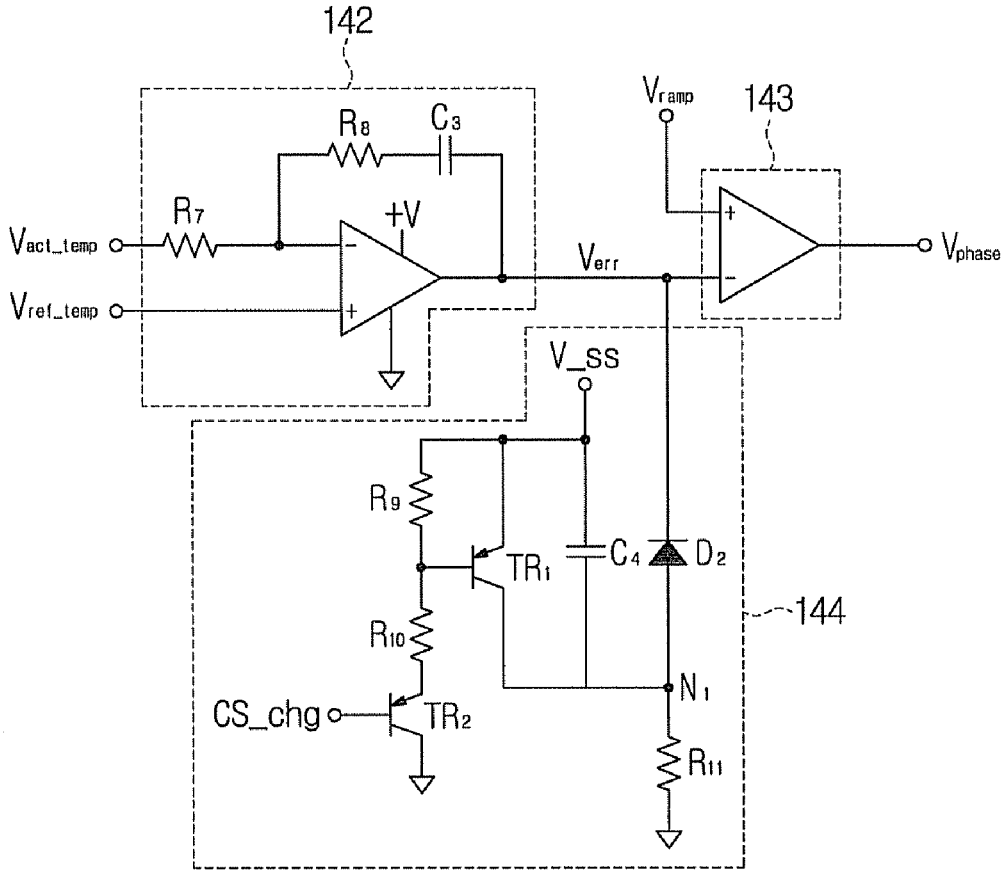
FIG. 4 is a circuit diagram of the phase controlling device of FIG. 3.

FIG. 3 is a block diagram explaining a phase controlling device according to one embodiment of the present invention, and FIG. 4 is a circuit diagram of an embodiment of the phase controlling device of FIG. 3;

Referring to FIG. 3, the phase controlling device 140 according to one embodiment of the present invention includes a pulse generating unit 141, a signal generating unit I 142, a control signal generating unit 143, and a signal generating unit II 144.

In detail, the pulse generating unit 141 generates a sawtooth wave pulse signal Vramp that increases over time during one-half of the period of AC power applied from the power supply unit 110.

Such a sawtooth wave pulse signal Vramp is in general a pulse signal provided from the Switching Mode Power Supply (SMPS) shown in FIG. 1 to the Pulse Width Modulator (PWM) for generating a switching pulse of the SMPS, and the pulse generating unit 141 may be constituted by a PWM controller (not shown) providing a sawtooth wave pulse signal Vramp. Here, the pulse generating unit 141 may use the PWM controller in common with the power supply unit 110, and may have a PWM controller used for the phase controlling unit 140.

The signal generating unit I 142 receives from the controller 150 shown in FIG. 1 a temperature detection signal Vact_temp outputted in correspondence to present or actual temperature that is provided by the controller 150 and a reference temperature signal Vref_temp outputted according to a predetermined target or reference temperature, carries out subtraction of voltage values of both, and outputs an error signal Verr according to a difference between the voltage values.

In detail, referring to FIG. 4, the signal generating unit I 142 is driven by a monopole input voltage +V, and includes a subtractor circuit consisting of an OP-AMP having an inversion input terminal (−) to which the Vact_temp signal is applied and a non-inversion input terminal (+) to which the Vref_temp signal is applied.

At this time, when the present or actual temperature of the fuser 200 shown in FIG. 1 differs from its target or reference temperature, the signal generating unit I 142 carries out subtraction of the Vact_temp signal and the Vref_temp signal through the subtractor circuit and outputs a Verr signal.

The control signal generating unit 143 receives the Vramp signal outputted from the pulse generating unit 141 and the Verr signal outputted form the signal generating unit I 142, compares the two signals, and outputs a Vphase signal.

In detail, referring again to FIG. 4, the control signal generating unit 143 includes a comparator circuit including an OP-AMP having an inversion input terminal (−) to which the Verr signal is applied, and a non-inversion input terminal (+) to which the Vramp signal is applied.

When a voltage level applied to the non-inversion input terminal (+) of the OP-AMP of the control signal generating unit 143 is lower than a voltage level applied to the inversion input terminal (−) thereof, it forms a structure outputting "high". Hence, if the Vramp signal has a higher voltage level than the Verr signal, the Vphase signal is outputted as an output signal of high voltage level. Meanwhile, if the Vramp signal has a lower voltage level than the Verr signal, the Vphase signal is outputted as an output signal of low voltage level.

The signal generating unit II 144 is provided to prevent excessive current inflow that occurs when AC power is applied to the fuser 200 shown in FIG. 1 in response to the Vphase signal outputted from the control signal generating unit 143, when the fuser is started, or an image forming apparatus (not shown) is restarted from the standby mode. The standby mode is a mode that restricts the operation of the fuser 200 to reduce power consumption by not printing.

The signal generating unit II 144 includes a differential circuit including a charging element C4, such as a capacitor, connected to a power supply voltage V_SS having a predetermined voltage level, and a resistance element R11 connected in parallel to the charging element C4.

Upon starting or restarting from the standby mode, the voltage level at a first node N1 is equal to the voltage level of the V_SS since the charging element C4 is not yet electrically charged. Later, the voltage level at the first node N1 declines gradually close to the voltage level of the ground voltage GND by discharge of the charging element C4.

The voltage level of the first node N1, declining from the V_SS to the GND, is provided to the inversion input terminal (−) of the control signal generating unit 143 as a soft start signal Vsts.

Therefore, when the fuser 200 is started, or restarted from the standby mode, the control signal generating unit 143 compares the Vramp signal and the Vsts signal for a certain amount of time, and outputs a Vphase signal having a pulse width that gradually increases.

The signal generating unit II 144 further includes switching elements TR1 and TR2 to discharge voltage of the charging element C4 upon starting, or restarting from the standby mode. These switching elements TR1 and TR2 are activated in response to a charge quantity control signal CS_chg to discharge the charging element C4.

Here, the switching elements TR1 and TR2 are formed with transistors, and any of switching elements such as a relay switch that can perform diverse switching operations can be used. The CS_chg signal may be provided from the controller 150 shown in FIG. 1.

The following will now explain in detail the phase controlling device and a driving method of the fuser controlling device having the same.

FIGS. 5A-5D are diagrams explaining a method of driving the fuser controlling device according to one embodiment of the present invention, and FIGS. 6A-6D are diagrams explaining a method of driving the fuser controlling device according to one embodiment of the present invention.

In particular, FIGS. 5A-5D diagrammatically show a process for controlling exothermic temperature of the fuser in the fuser controlling device, and FIGS. 6A-6D diagrammatically show a process for performing a soft start function to prevent transient current flow into the fuser.

First, referring to FIGS. 1, 4, and 5A-5D, the fuser controlling device 100 continuously receives AC power from the power supply unit 110 and the power conversion unit 120. Accordingly, the phase sensing unit 130 detects zero-cross points according to change in phase of the AC power and outputs a phase detection signal.

The controller 150 determines present or actual temperature of the fuser 200 and outputs a Vact_temp signal corresponding to the present or actual temperature, and outputs a Vref_temp signal having the voltage level corresponding to a predetermined target or reference temperature of the fuser 200. At this time, the controller 150 either blocks the supply of the V_SS or applies a CS_chg signal to the signal generating unit II 144 to prevent its operation.

The signal generating unit I 142 of the phase controlling unit 140 receives the Vact_temp signal and the Vref_temp signal, carries out subtraction, and generates a Verr signal having a voltage level corresponding to the subtraction result.

Figure 5A:
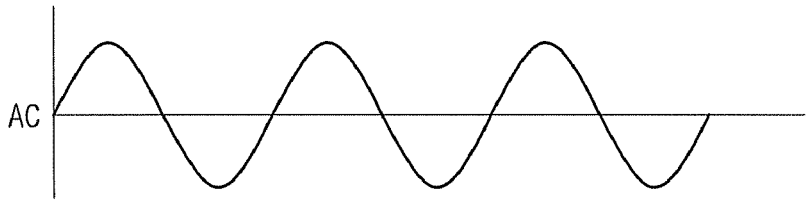
FIGS. 5A-5D are diagrams explaining a method of driving the fuser controlling device of FIG. 1.
Figure 5B:
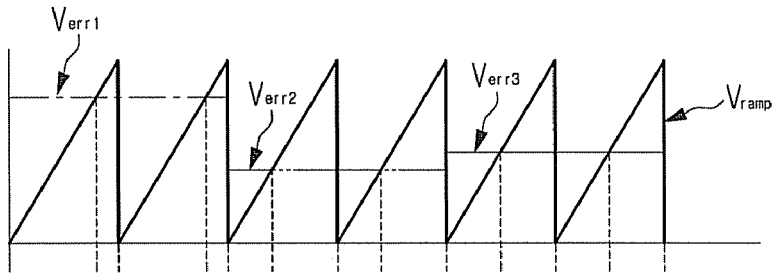

For instance, when the present or actual temperature of the fuser 200 is higher than its target or reference temperature, the Vact_temp signal and the Vref_temp signal undergo subtraction through the subtractor circuit and as a result, the Verr signal from the signal generating unit I 142 is outputted as a Verr1 signal having a relatively higher voltage level (FIG. 5B). The Verr1 signal is inputted to the inversion input terminal (−) of the OP-AMP of the control signal generating unit 143. That is, the Verr signal outputted from the signal generating unit I 142 has a voltage level that is proportional to a temperature variation of the fuser 200.

Figure 5C:
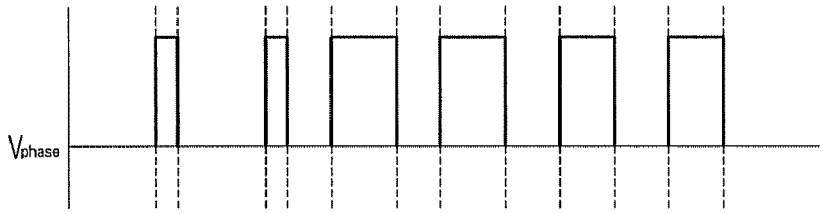
Figure 5D:
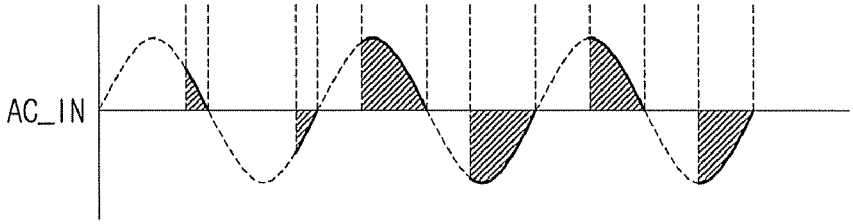

At this time, the non-inversion input terminal (+) of the OP-AMP of the control signal generating unit 143 receives a Vramp signal that increases with the passage of time during a half period of the AC power input from the pulse generating unit 141. Thus, the control signal generating unit 143 outputs a high voltage level Vphase signal only in a section where the Vramp signal has a higher voltage level than the Verr1 signal (FIG. 5C). Accordingly, a phase of the input AC power is controlled by the fuser controlling unit 160 that is activated by the Vphase signal, and the phase controlled AC power is then applied to the fuser 200. Also, as illustrated in FIG. 5D, AC power AC_IN controlled by a Vphase signal having a relatively narrower pulse width is applied to the fuser 200. As the fuser 200 is heated for a comparatively short period of time, exothermic temperature of the fuser 200 is decreased.

On the other hand, when the present or actual temperature of the fuser 200 is lower than its target or reference temperature, the Verr signal is outputted as a Verr2 signal having a relatively lower voltage level (FIG. 5B). The Verr2 signal is applied to the inversion input terminal (−) of the OP-AMP of the control signal generating unit 143, while a Vramp signal that increases with the passage of time during a half period of the AC power impressed from the pulse generating unit 141 is applied to the non-inversion input terminal (+) of the OP-AMP of the control signal generating unit 143.

Therefore, the control signal generating unit 143 outputs, based on a phase detection signal outputted from the phase sensing unit 130, a Vphase signal of a high voltage level only in a section where the Vramp signal has a higher voltage level than the Verr2 signal. Then, the input AC power undergoes the phase control by the fuser controlling unit 160 that is activated by the Vphase signal, and the phase controlled AC power is input to the fuser 200. In addition, AC power AC_IN controlled by a Vphase signal having a relatively broader pulse width is applied to the fuser 200. As the fuser 200 is heated for a comparatively long period of time, exothermic temperature of the fuser 200 is increased.

Next, referring to FIGS. 6A-6D, the fuser controlling device 100 continuously receives AC power from the power supply unit 110 and the power conversion unit 120. Accordingly, the phase sensing unit 130 detects zero-cross points according to changes in phase of the AC power and outputs a phase detection signal. At this time, the controller 150 blocks the output of the Vact_temp signal or the Vref_temp signal to prevent the operation of the signal generating unit I 142.

When the fuser 200 shown in FIG. 1 is started, or restarted from the standby mode, the voltage level at a first node N1 of the signal generating unit II 144 is equal to the voltage level of the V_SS since the charging element C4 is not yet charged electrically. Later, the voltage level at the first node N1 declines gradually close to the voltage level of the ground voltage GND by discharge of the charging element C4.

Figure 6A:
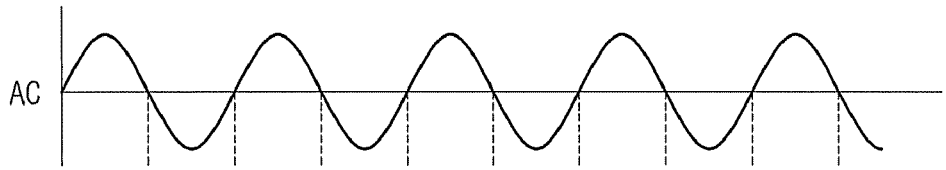
FIGS. 6A-6D are diagrams explaining a method of driving the fuser controlling device of FIG. 1.
Figure 6B:
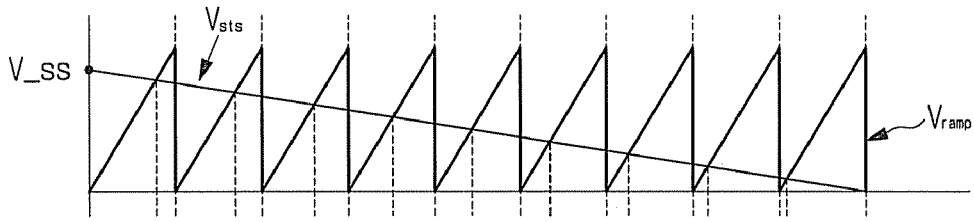
Figure 6C:
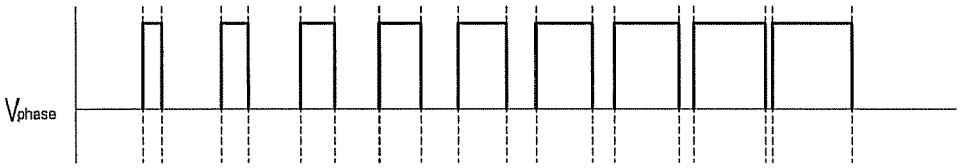
Figure 6D:
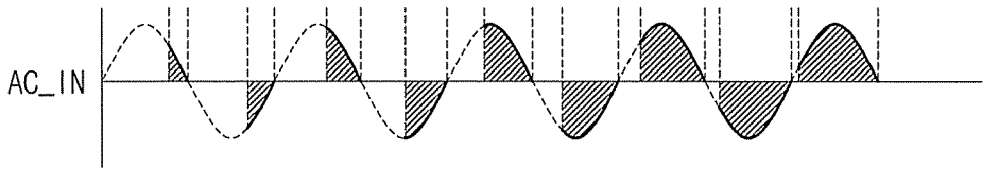
Figure 7:
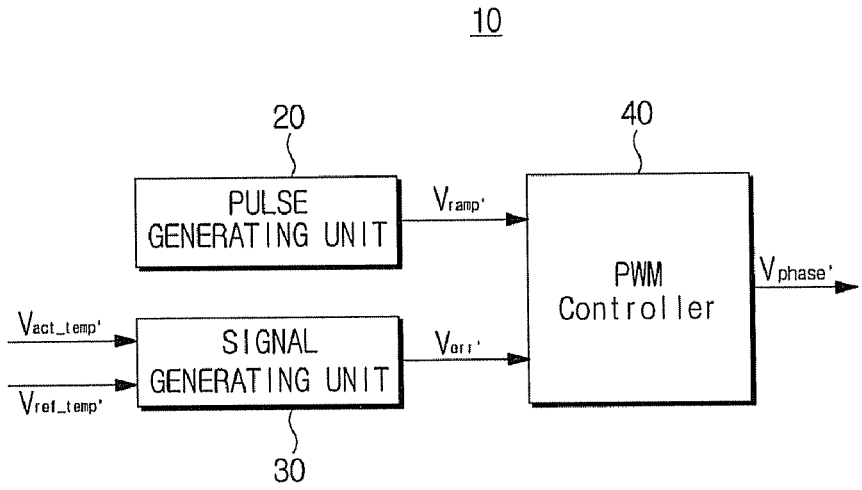
FIG. 7 (PRIOR ART)
FIG. 7 is a block diagram explaining a conventional phase controlling device as a comparative example.
Figure 8:
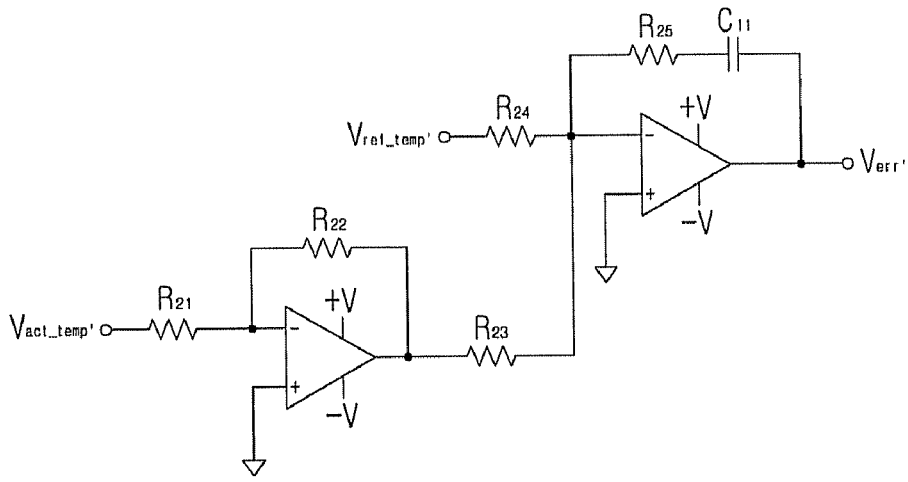
FIG. 8 (PRIOR ART)
FIG. 8 is a circuit diagram of a signal generation unit shown in FIG. 7.
Figure 9A:
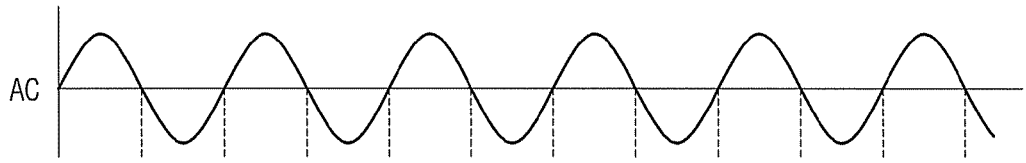
FIG. 9A (PRIOR ART)
FIGS. 9A-9D are diagrams explaining a method of driving a fuser controlling device provided with the phase controlling device of FIG. 7.
Figure 9B:
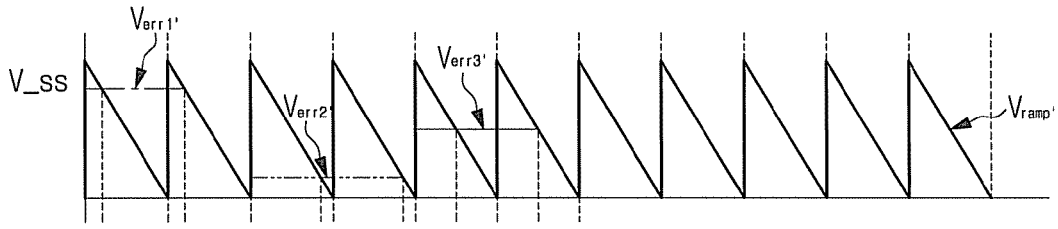
FIG. 9B (PRIOR ART)
Figure 9C:
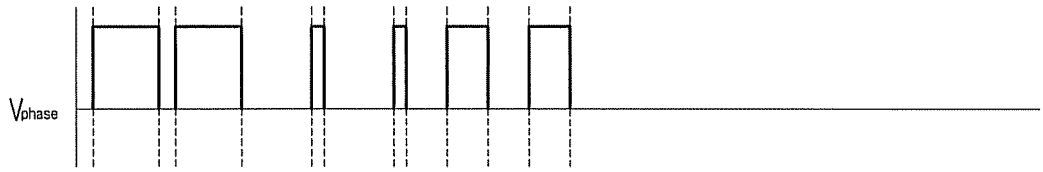
FIG. 9C (PRIOR ART)
Figure 9D:
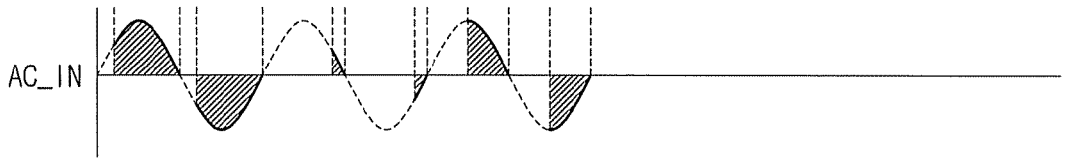
FIG. 9D (PRIOR ART)
Figure 10A:
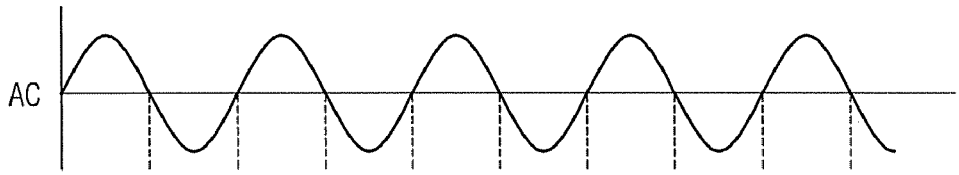
FIG. 10A (PRIOR ART)
FIGS. 10A-10D are diagrams explaining a method of driving a fuser controlling device provided with the phase controlling device of FIG. 7.
Figure 10B:
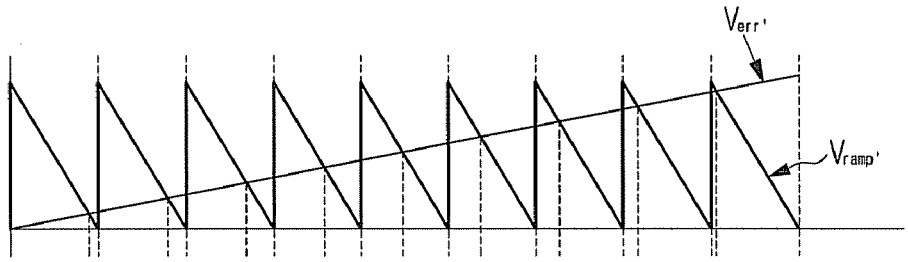
FIG. 10B (PRIOR ART)
Figure 10C:
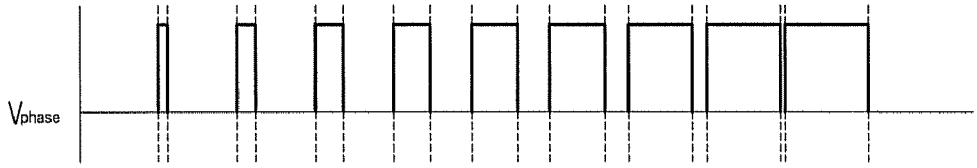
FIG. 10C (PRIOR ART)
Figure 10D:
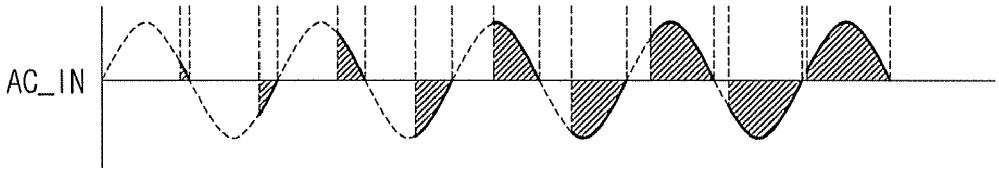
FIG. 10D (PRIOR ART)

As such, the voltage level of the first node N1 declining from the V_SS to the GND is provided to the inversion input terminal (−) of the control signal generating unit 143 as a soft start signal Vsts (FIG. 6B). Here, for convenience of explanation and understanding, it is assumed that the voltage level of the Vsts signal decreases from the voltage level of the V_SS along a straight line having a certain slope. In practice, however, it decreases exponentially by discharge of the charging element C4.

Therefore, the control signal generating unit 143 compares the voltage level of the Vsts signal that gradually decreases with the passage of time and the voltage level of the Vramp signal that is outputted from the signal generating unit 141, and outputs a Vphase signal of a high voltage level when the Vramp has a comparatively higher voltage level than the Vsts signal.

As such, the Vphase signal is outputted to have a pulse width gradually increasing from the starting point until a predetermined time (FIG. 5C), and is applied to the fuser controlling unit 160 shown in FIG. 1. By this Vphase signal applied to the fuser controlling unit 160, the phase of the AC power is controlled and then the phase controlled AC power is impressed to the fuser 200. Thus, because the AC_IN is applied to the fuser controlling unit 160 over gradually increasing time, it becomes possible to prevent transient current flow to the fuser 200 that occurs when a relatively great AC power is applied instantly.

As explained so far, according to an aspect of the present invention, since phase control is performed by using a pulse signal that increases with time, it is not necessary to use a bipolar power supply as in the comparative example and the circuit configuration for carrying out phase inversion of a signal may be removed. In other words, the costly IC exclusive for phase control used in the comparative example is no longer needed.

In addition, according to an aspect of the present invention, since phase control is performed using a sawtooth wave pulse signal increasing with the passage of time, the circuit configuration is simplified and thus, the cost of manufacture of the high integration and phase controlling devices can be reduced.

Therefore, because the phase controlling device of an aspect of the present invention may not necessarily include an independent pulse generating unit for generating a pulse signal that reduces by time variation nor a circuit configuration for generating a signal of inverted polarity used for carrying out phase control, the cost of manufacture thereof can be reduced.

Moreover, by performing a soft start function using a signal that is reduced with the passage of time, it is possible to protect constituent elements of the fuser from transient current flow and to prevent any malfunction of the product. Consequently, overall product reliability of the phase controlling device, the fuser controlling device having the same, and further the image forming apparatus mounted with these devices can be improved.

Although a few embodiments of the present invention have been shown and described, it would be appreciated by those skilled in the art that changes may be made in this embodiment without departing from the principles and spirit of the invention, the scope of which is defined in the appended claims and their equivalents.

What is claimed is:

1. A phase controlling device controlling a phase of alternating current (AC) power to regulate to a predetermined temperature an exothermic temperature of a fuser of an image forming apparatus, the phase controlling device comprising:

a first signal generating unit generating an error signal that corresponds to a difference between the predetermined temperature of the fuser and an actual temperature of the fuser;

a second signal generating unit generating a soft start signal that drives the fuser to prevent transient current flow from occurring during a start of the fuser, and providing the soft start signal to the control signal generating unit;

a pulse generating unit generating a sawtooth wave pulse signal that increases with time during a half period of the AC power; and a control signal generating unit comparing the error signal and the sawtooth wave pulse signal and outputting a phase control signal controlling the phase of the AC power, wherein the second signal generating unit comprises a differential circuit between a power supply voltage having a first predetermined voltage level and a second predetermined voltage level.

2. The device of claim 1, wherein the soft start signal generated by the second signal generating unit has a voltage level that decreases with time.

3. The device of claim 2, wherein the control signal generating unit compares a voltage level of the soft start signal and a voltage level of the sawtooth wave pulse signal for a predetermined time from the start of the fuser, and outputs the phase control signal having a pulse width that increases with time.

4. The device of claim 1, wherein the second signal generating unit further comprises a switching element that is connected in parallel to a charging element included in the differential circuit to discharge the charging element.

5. The device of claim 1, wherein the first signal generating unit comprises a subtractor carrying out subtraction of the reference temperature and the actual temperature being inputted, the subtractor being driven by a monopole voltage and outputting the error signal having a voltage level in proportion to a temperature variation of the fuser.

6. The device of claim 5, wherein the subtractor comprises an OP-AMP comprising a non-inversion input terminal to which a voltage level corresponding to the reference temperature is inputted and an inversion input terminal to which a voltage level corresponding to the actual temperature is inputted.

7. The device of claim 5, wherein the control signal generating unit compares a voltage level of the error signal outputted from the subtractor and a voltage level of the sawtooth wave pulse signal, and outputs the phase control signal of a high voltage level when the voltage level of the sawtooth wave pulse signal is higher than the voltage level of the error signal.

8. A fuser controlling device controlling exothermic temperature of the fuser installed in an image forming apparatus, the fuser controlling device comprising:

a power supply unit applying an alternating current (AC) power to the fuser;

a phase controlling unit outputting a phase control signal controlling a phase of the AC power using a pulse signal that increases with time during a half period of the AC power; and a fuser controlling unit being activated by the phase control signal, and controlling application of the AC power to the fuser, wherein the phase controlling unit comprises:

a first signal generating unit generating an error signal that corresponds to a difference between a reference temperature of the fuser and an actual temperature of the fuser;

a pulse generating unit generating a sawtooth wave pulse signal that increases with time during a half period of the AC power;

a control signal generating unit comparing the error signal and the sawtooth wave pulse signal and outputting the phase control signal controlling the phase of the AC power; and a second signal generating unit generating a soft start signal that drives the fuser to prevent transient current flow occurring during a start of the fuser, and providing the soft start signal to the control signal generating unit, wherein the second signal generating unit comprises a differential circuit between a power supply voltage having a first predetermined voltage level and a second predetermined voltage level.

9. The device of claim 8, wherein the soft start signal generated by the second signal generating unit has a voltage level decreasing with time.

10. The device of claim 9, wherein the control signal generating unit compares a voltage level of the soft start signal and a voltage level of the sawtooth wave pulse signal a predetermined time from the start of the fuser, and outputs the phase control signal having a pulse width that increases with time.

11. The device of claim 8, wherein the first signal generating unit is driven by a monopole voltage and outputs the error signal having a voltage level in proportion to temperature variation of the fuser.

12. The device of claim 11, wherein the control signal generating unit compares a voltage level of the error signal outputted from the first signal generating unit and a voltage level of the sawtooth wave pulse signal, and outputs the phase control signal of a high voltage level when the voltage level of the sawtooth wave pulse signal is higher than a voltage level of the error signal.

13. A phase controlling method controlling a phase of alternating current (AC) power to regulate exothermic temperature of a fuser of an image forming apparatus to a reference temperature, the method comprising:

generating an error signal corresponding to a difference between the reference temperature of the fuser and an actual temperature of the fuser;

generating a soft start signal that drives the fuser to prevent transient current flow occurring during a start of the fuser;

generating a sawtooth wave pulse signal that increases with time during a half period of the AC power; and comparing the error signal and the sawtooth wave pulse signal and thereby, outputting a phase control signal controlling the phase of the AC power, wherein the generating a soft signal comprises executing differential operation using a differential circuit between a power supply voltage having a first predetermined voltage level and a second predetermined voltage level.

14. The method of claim 13, wherein the soft start signal has a voltage level that decreases with time from the start of the fuser.

15. The method of claim 14, wherein the phase control signal has a pulse width that increases with time from the start of the fuser.

16. The method of claim 13, wherein the error signal has a voltage level in proportion to a temperature variation of the fuser.

17. The method of claim 16, wherein the phase control signal is outputted as a high voltage level signal when a voltage level of the sawtooth wave pulse signal is higher than a voltage level of the error signal.

18. A device controlling actual temperature of a fuser of an image forming apparatus, the device comprising:

a power supply unit supplying AC power;

a power conversion unit coupled to the power supply unit;

a phase sensing unit coupled to the power supply unit;

a phase controlling unit coupled to the phase sensing unit;

a controller coupled to the phase controlling unit; and a fuser controlling unit, wherein the phase controlling unit generates a phase control signal corresponding to a difference between a reference temperature and the actual temperature of the fuser, transmits the phase control signal to the fuser controlling unit and the fuser controlling unit controls the AC power input to the fuser according to the phase control signal, wherein the phase controlling unit includes a pulse generating unit and first and second signal generating units, wherein the second signal generating unit comprises a differential circuit between a power supply voltage having a first predetermined voltage level and a second predetermined voltage level.

19. The device of claim 18, wherein the power supply unit includes a switching mode power supply.

20. The device of claim 18, wherein the phase sensing unit detects zero-cross points of the AC power, and outputs a phase detection signal between the zero-cross points.

21. The device of claim 20, wherein the phase controlling unit outputs the phase control signal using the phase detection signal output from the phase sensing unit.

22. The device of claim 18, wherein the controller checks the actual temperature of the fuser to generate a temperature detection signal having a voltage level corresponding to the actual temperature, and outputs the temperature detection signal to the phase control signal.

23. The device of claim 22, wherein the phase controlling unit generates an error signal corresponding to a difference between a reference temperature signal stored in the controller and the temperature detection signal output by the controller, compares the generated error signal and a predetermined pulse signal and outputs the phase control signal.

24. The device of claim 18, wherein the fuser comprises a heating roller and a pressing roller.

25. The device of claim 18, wherein the fuser controlling unit includes a first switching unit, a second switching unit, a current limiting unit, and a noise prevention unit.

26. The device of claim 25, wherein the noise prevention unit prevents noises when an internal pressure of the second switching unit changes to a turn-on voltage from 0V.

* * * * *